US005742265A

United States Patent [19]

Stoller et al.

[11] Patent Number: 5,742,265

[45] Date of Patent: Apr. 21, 1998

[54] AC PLASMA GAS DISCHARGE GRAY SCALE GRAPHIC, INCLUDING COLOR AND VIDEO DISPLAY DRIVE SYSTEM

[75] Inventors: Ray A. Stoller, Paulding; Michael B. Stalker, Sylvania, both of Ohio

[73] Assignee: Photonics Systems Corporation, Northwood, Ohio

[21] Appl. No.: 8,239

[22] Filed: Jan. 21, 1993

Related U.S. Application Data

[63] Continuation of Ser. No. 626,718, Dec. 17, 1990, abandoned.

[51] Int. Cl.[6] ..... G09G 3/28

[52] U.S. Cl. ..... 345/60; 345/61

[58] Field of Search ..... 340/771, 798, 340/799, 793, 703, 701, 750, 747; 364/518, 521; 395/162, 163, 164; 345/60, 61, 62, 63, 64, 65, 77, 41

[56] References Cited

U.S. PATENT DOCUMENTS

| | | | |
|---|---|---|---|
| 3,863,023 | 1/1975 | Schmersal et al. | 358/240 |
| 3,997,719 | 12/1976 | Judice | 340/793 |
| 4,002,828 | 1/1977 | Nolan | 340/793 |
| 4,006,298 | 2/1977 | Fowler et al. | 340/793 |
| 4,067,047 | 1/1978 | Ryan | 340/793 |
| 4,142,181 | 2/1979 | Moricca et al. | 340/781 |
| 4,169,659 | 10/1979 | Marlowe | 358/150 |
| 4,194,215 | 3/1980 | Shionoya | 358/240 |
| 4,233,623 | 11/1980 | Pavlischuk | 358/240 |
| 4,246,609 | 1/1981 | Van Der Valk | 358/150 |
| 4,310,840 | 1/1982 | William et al. | 340/798 |
| 4,316,219 | 2/1982 | Smith et al. | 358/150 |
| 4,320,418 | 3/1982 | Pavlischuk | 340/771 |
| 4,378,556 | 3/1983 | Wisnieff | 340/767 |
| 4,417,275 | 11/1983 | Harshberger et al. | 358/139 |
| 4,467,360 | 8/1984 | Fosse | 358/197 |
| 4,500,909 | 2/1985 | Machida | 358/17 |

(List continued on next page.)

FOREIGN PATENT DOCUMENTS 0334524 9/1989 European Pat. Off. .

OTHER PUBLICATIONS

Electronic Engineering Times, Nov. 12, 1990 p. 100.

Preliminary Data Sheet Mar. 1992 "19 inch Full Color AC Plasma HDS Video Monitor".

"Topics In Applied Physics, vol. 40—Display Devices", J.I. Pankove (55 pp.).

(List continued on next page.)

*Primary Examiner*—Chanh Nguyen

*Attorney, Agent, or Firm*—Jim Zegeer, Esq.

[57] ABSTRACT

A novel drive system is described for AC plasma (ACP) gas discharge flat bistable matrix panels on which real-time video and computer graphics, both with pixel by pixel gray scale are displayed. The drive scheme increases scan speed, reduces complexity and minimizes circuitry required to operate the video and computer graphics gray scale images on the ACP display through: a) unique application of standard high density memory IC architecture, and b) unique panel drive waveform technique. Flicker is avoided with an interlaced framerate of 46 Hz and non-sequential pixel row scanning. The unique panel drive scheme allows high speed operation to avoid flicker in the ACP panel for real time gray scale video and graphic images. Because of the high speed addressing requirements, the panel waveform techniques apply all of the drive voltages to the ACP panel from the row (Y) axis and only selective cancellation voltage from the column (X) axis. This technique results in ground based data transfer from the memory circuits to the column driver ICs, and eliminates significant level shifting through multiple parallel isolation circuits such as transformers or optical couplers. Avoidance of isolation circuits in the X-axis allows higher speed transfer of data into column drivers. The panel addressing requirements for pixel-by-pixel gray scale is minimized through geometric accumulation of pixel on-time per frame. At least 64 levels of gray scale are provided in standard neon ACP displays with pixel rows of 256, 480 and 512, for example.

5 Claims, 7 Drawing Sheets

U.S. PATENT DOCUMENTS

| | | | |
|---|---|---|---|
| 4,518,995 | 5/1985 | Harshberger et al. | 358/139 |
| 4,566,005 | 1/1986 | Apperley et al. | 340/771 |
| 4,583,118 | 4/1986 | Mallinson et al. | 358/148 |
| 4,611,225 | 9/1986 | Powers | 358/140 |
| 4,616,260 | 10/1986 | Erwin et al. | 358/150 |
| 4,679,091 | 7/1987 | Kikuchi et al. | 358/242 |
| 4,684,987 | 8/1987 | Tsutsui | 358/148 |
| 4,713,692 | 12/1987 | Kirkland | 358/150 |
| 4,747,081 | 5/1988 | Heilveil et al. | 340/799 |
| 4,760,455 | 7/1988 | Nagashima | 358/242 |
| 4,769,704 | 9/1988 | Hirai et al. | 358/148 |
| 4,774,576 | 9/1988 | Lilley | 358/141 |
| 4,779,132 | 10/1988 | McBeath et al. | 358/148 |
| 4,800,429 | 1/1989 | Perkins | 358/148 |
| 4,818,982 | 4/1989 | Kuehn et al. | 340/793 |
| 4,821,112 | 4/1989 | Sakamoto et al. | 358/17 |
| 4,827,255 | 5/1989 | Ishii | 340/793 |
| 4,833,464 | 5/1989 | Di Santo et al. | 340/793 |
| 4,845,481 | 7/1989 | Havel | 340/767 |
| 4,860,090 | 8/1989 | Murata et al. | 358/13 |
| 4,860,098 | 8/1989 | Murphy | 358/139 |
| 4,890,100 | 12/1989 | Kurakake et al. | 340/799 |
| 4,897,723 | 1/1990 | Arai | 358/158 |
| 4,916,442 | 4/1990 | Kim | 340/814 |
| 4,921,334 | 5/1990 | Akodes | 340/793 |
| 4,933,749 | 6/1990 | Van Lammeren et al. | 358/23 |
| 4,951,041 | 8/1990 | Inada et al. | 340/793 |
| 4,962,427 | 10/1990 | Lunn et al. | 358/188 |
| 4,962,428 | 10/1990 | Tong et al. | 358/188 |
| 4,974,064 | 11/1990 | Tsinberg | 358/12 |
| 4,996,595 | 2/1991 | Naito et al. | 358/150 |
| 5,025,310 | 6/1991 | Sekiya et al. | 358/19 |
| 5,027,212 | 6/1991 | Marlton et al. | 358/183 |

OTHER PUBLICATIONS

"Display Driver Handbook" Texas Instruments 1983, pp. 2–15 to 2–31.

"Interface For Color—Video Monitor", NASA Tech Briefs 6SC—13076, Jun. 1986.

"WD90C60 Video Graphics Array Clock" © 1990 Western Digital Corporation.

A Pulse Discharge Panel Display For Producing a Color TV Picture W/HIGH Luminance & Luminous Efficay IEEE Transactions On Electron Devices, vol. ED. 29, No. 6, Jun. 1982.

"14.4 Color TV Display W/AC—PDP", Yokozawa et al NHK Technical Research Laboratories, Japan Display, 1983.

"13.1—Invited Plasma Display Technologies For a Flat—Panel Color Television", Murakami, NHK Science and Technical Research Laboratories, Tokyo, Japan Display, 1986.

"A Planar Single—Substrate AC Plasma Display w/Capacitive Vias", Dick et al., ©1979 IEEE.

"The Marketplace Votes On VGA", Cox, Information Display Sep. 1990.

"Enhanced VGA Boards Pose Compatibility Problems", EDN Jun. 29, 1989.

"Multisynchronous Monitors: Paying For Flexibility", Rosen, Information Display Mar. 1990.

"High Resolution Monitors Emerge To Meet Advanced Graphics Needs", Bedford, Princeton Graphics Systems, 1990.

"Enhanced EGA and VGA Boards", Franklin, Jr., Byte. Mar. 1988.

"VGA Teaches PC/AT Table Manners", McAllister, Mini—Micro Systems, May 1988.

"Flicker Free VGA Can Increase User's Productivity", Computer Technology Review, Aug. 1990.

AC PLASMA GAS DISCHARGE GRAY SCALE GRAPHIC, INCLUDING COLOR AND VIDEO DISPLAY DRIVE SYSTEM

This is a continuation of application Ser. No. 07/626/718, filed Dec. 17, 1990, which was abandoned upon the filing hereof.

BACKGROUND AND BRIEF DESCRIPTION OF THE INVENTION

Creation of pixel-by-pixel gray scale in bistable AC plasma (ACP) displays and DC plasma displays modified to provide bistability has been both studied and demonstrated over the last 20 years. Moreover, full color plasma displays employ pixel-by-pixel gray scale within each color channel. Although the concept has been demonstrated several times, it has been difficult to implement as a product because adequate drive systems were not able to avoid flicker and operate with real time non-interlaced digitized video sources such as VGA.

An early development model, when operated at 30 Hz update and with sequential pixel row scan, has especially noticeable flicker with still frame video and computer generated images. Most prior art gray scale plasma display demonstrations are either not capable of video rate update, or are specifically for broadcast video. In the first case, flicker may be avoided at the expense of not having real time video capability. In the second case, the operation with continuously changing video images tends to mask flicker. In any case, 30 Hz update operation on the ACP display does not sufficiently avoid flicker in static images, although it has been tolerated as an NTSC standard for CRTs. IBM's recently introduced 8514 and 8515 VGA monitors are based on a frame rate of 43.5 Hz for flickerless interlaced operation (Reference Computer Technology 30 view, August 1990, Flicker Free VGA Can Increase User's Productivity). This invention uses 46 Hz (or greater) interlaced update of the display in addition to nonsequential row scan to avoid flicker.

The bistable ACP display is currently produced by several organizations in Europe, Japan and the U.S., each organization making its own versions/configurations of the basic ACP technology. The basic technology incorporates neon gas mixtures as the display medium in the cavity where the matrix imposes pixel-by-pixel control voltages. The matrix may be located on one substrate or on two opposing substrates.

The neon gas mixtures used in ACP displays has certain physical response times which must be accommodated by all electronic drive systems:

1) The neon gas ion mobility is such that 5 microseconds must be allowed after each gas discharge for the ions to be redistributed for bistability in the cell.
2) The erase phenomenon whereby a partial discharge is invoked requires at least 3.5 microseconds duration at discharge cell zero potential.

ACP displays generally have interlaced electrodes which form the X-axis and Y-axis matrix lines: every other electrode is brought out to the edges of the panel so that there is a set of even connections (0, 2, 4, 6 . . . ) and odd connections (1, 3, 5, 7 . . . ) at the top and bottom respectively, and at the left and right sides, respectively. This electrode connection implementation has been employed to reduce the resolution requirements for drive system interconnect.

VGA BACKGROUND

VGA has become an industry standard de facto. The invention is intended to allow operation with the output from one of the color channels available from VGA sources, typically the Green channel. VGA is the dominant graphics format by far, accounting for 65–75% of all the retail color market and nearly 50% of all monitors (Reference The Marketplace Votes On VGA, Information Display 9/90, pp. 10, 11). VGA requires an analog monitor; that is, each of its R, G and B outputs is 1 volt peak-to-peak analog data. Its horizontal and vertical sync signals, however, are in digital TTL form. Note that the analog data signals for R, G and B are created from digital data which is converted to analog.

Although VGA is a color standard, it is also quite accepted as a monochrome configuration. The standard screen format is 480 pixel rows and 640 column rows. An extended format can either be 600×800 or 768×1024. VGA offers greater clarity than EGA or CGA; it is able to display 256 simultaneous colors from a palette of more than 262,000, and also features high resolution 8×16 text cells. Relative to monochrome applications, up to 64 levels of gray scale are provided per single channel. There are many suppliers of both VGA boards and/or circuits to drive VGA monitors. For example, Western Digital Imaging supplies chip sets for the Paradise VGA card. Many publications over the last 3 years have presented information about VGA, including these examples: VGA Teaches PC/AT Table Manners, MINI-MICRO SYSTEMS, May 1988, pp. 87–98; Enhanced EGA and VGA Boards, BYTE, March 1988, pp. 102–112; Enhanced VGA Boards Pose Compatibility Problems, EDN, 29 Jun. 1989, pp. 8–15; High Resolution Monitors Emerge to Meet Advanced Graphics Needs, Computer Technology Review, Spring 1990, pp. 95–99; and Multisynchronous Monitors: Paying for Flexibility, Information Display 5/90, pp. 17–19.

The standard horizontal frequency for 480×640 VGA is 31.5 kHz. There are actually two VGA pixel frequencies (Reference for example Western Digital's VGA Clock chip, part number WD90C60, data sheet number 79-000512); 25 MHz for graphics mode and 28 MHz for text mode. VGA chip sets and/or PC boards provide the necessary outputs to analog monitors, but many VGA compatible monitors also have multisyncing capabilities which allow a range of frequencies and images to be displayed.

PRIOR ART BACKGROUND

One comprehensive reference for plasma display technology is Topics in Applied Physics, Volume 40—Display Devices, published by Spring-Verlag, J. I. Pankove Editor, 1980. Grayscale operation in plasma displays is discussed in Section 3.8.3 therein, including a SID presentation by engineers from GTE who patented their disclosure of AC Plasma Panel TV Display with 64 Discrete Intensity Levels.

Another reference regarding the drive system for plasma displays is contained in Display Driver Handbook, Driving High Voltage and Flat-Panel Displays, Texas Instruments, 1983, pp. 2–15 through 2–31.

Gray scale driving in plasma displays has also been reported for color plasma displays in Japan: for examples, A Pulse Discharge Panel Display for Producing a Color TV Picture with High Luminance and Luminance Efficacy, NHK authors, IEEE Transactions on Electron Devices, Vol. ED-29, No. 6, June 1982; and Color TV Display with AC-PDP, NHK authors, pp. 514 & 515, Japan Display, 1983.

Thomson CSF of France is advertising 8 level gray scale AC plasma displays, but has not disclosed their approach. Reference AC Plasma Display Panels, Product Selection Guide, Thomson Tubes Electroniques, TTE 15G GP, May 1989.

Toshiba and Panasonic have been offering some plasma display panels with up to 16 levels of gray scale which are designed specifically for personal laptop computer applications. It is understood that they are not capable of full video rate operation.

Fujitsu has just begun offering an AC plasma display with 16 levels of gray scale and VGA compatibility. Reference Electronic Engineering Times, Nov. 12, 1990, page 100. Fujitsu is marketing the display in coordination with a Western Digital VGA controller which apparently buffers the display from real-time analog video that normally would be the output from VGA sources.

Development of AC plasma displays with the matrix located on one substrate is basically represented in A Planar Single-Substrate AC Plasma Display with Capacitive Vias, George W. Dick, Proceedings of the SID, Vol. 20/5, 1979; and Characteristics of Surface-Discharge Color AC Plasma Display Panels, Fujitsu authors, pp. 164 & 165, SID 1981 Digest; and Plasma Display Technologies for A Flat-Panel Color Television, NHK author, Japan Display 1986, pp. 490 through 493.

SUMMARY OF THE INVENTION

It is an object of the invention to provide a drive system for ACP panels on which real time video and computer graphics, both with pixel-by-pixel gray scale are displayed. It is especially an object to provide a system which avoids flicker and allows display of real time non-interlaced digitized video such as VGA in addition to standard interlaced "broadcast" video such as NTSC.

It is additionally an object of the invention to implement the drive system in an efficient minimal design featuring unique application of standard high density memory architectures and employment of a unique panel waveform in which all of the drive voltage is applied from the row axis of the panel and the column axis is dedicated solely to high speed pixel control which is logic ground based.

The invention's efficient minimal design has the following practical advantages over a less efficient minimal design:

1) Less circuitry, which results from the invention's unique application of standard high density memory architecture, and from the invention's unique panel waveform; allows a more compact display with less power dissipation, higher reliability and more cost effectivity.

2) Fewer architecture functions, which result from the invention's unique application of standard high density memory architecture, and from the invention's unique panel waveform; allows more pixel data throughput for higher speed operation necessary to avoid flicker and to accept real time non-interlaced video.

A drive system is described herein for flat panel bistable matrix AC Plasma gas discharge gray scale graphics and video displays with: capability to provide in standard neon gas AC plasma panels at least 64 levels of gray in interlaced matrices of 256×512, 480×640, 512×512, 576×640, 512×832 and 512×1024, (and other combinations) and up to 128 levels of gray in interlaced matrices of 256×512; performance of the gray scale capability while avoiding flicker with overall framerate of 46 Hz, non-sequential interlaced pixel row scanning, and accumulative geometric pixel on-time per frame; performance of the gray scale capability with voltage drive waveforms which allow time to accomplish avoidance of flicker and in which all of the drive voltage is applied from the row axis of the panel and the column axis is dedicated solely to high speed pixel control which is logic ground based. The invention permits implementation of the drive system in an efficient minimal design based on unique, unusual application of standard high density memory architecture. According to the invention, video data is captured as bytes of column pixel data into FIFOs, serialized in the FIFOs and shifted into all of the VRAM serial access registers at one time, uploaded into VRAM memory arrays, and parallel accessed from all of the VRAMs at the same time for output into the display driver ICs. Finally, the invention includes a memory architecture specifically providing the above described direct throughput of pixel data without bit rotation or translation enroute to the display drivers, and without interleaving at the driver outputs, or in the printed circuit connections to the ACP panel; resulting in direct pixel orientation for gray scale control by accumulative geometric on-time per frame.

DETAILED DESCRIPTION OF THE DRAWINGS

Figure 1:
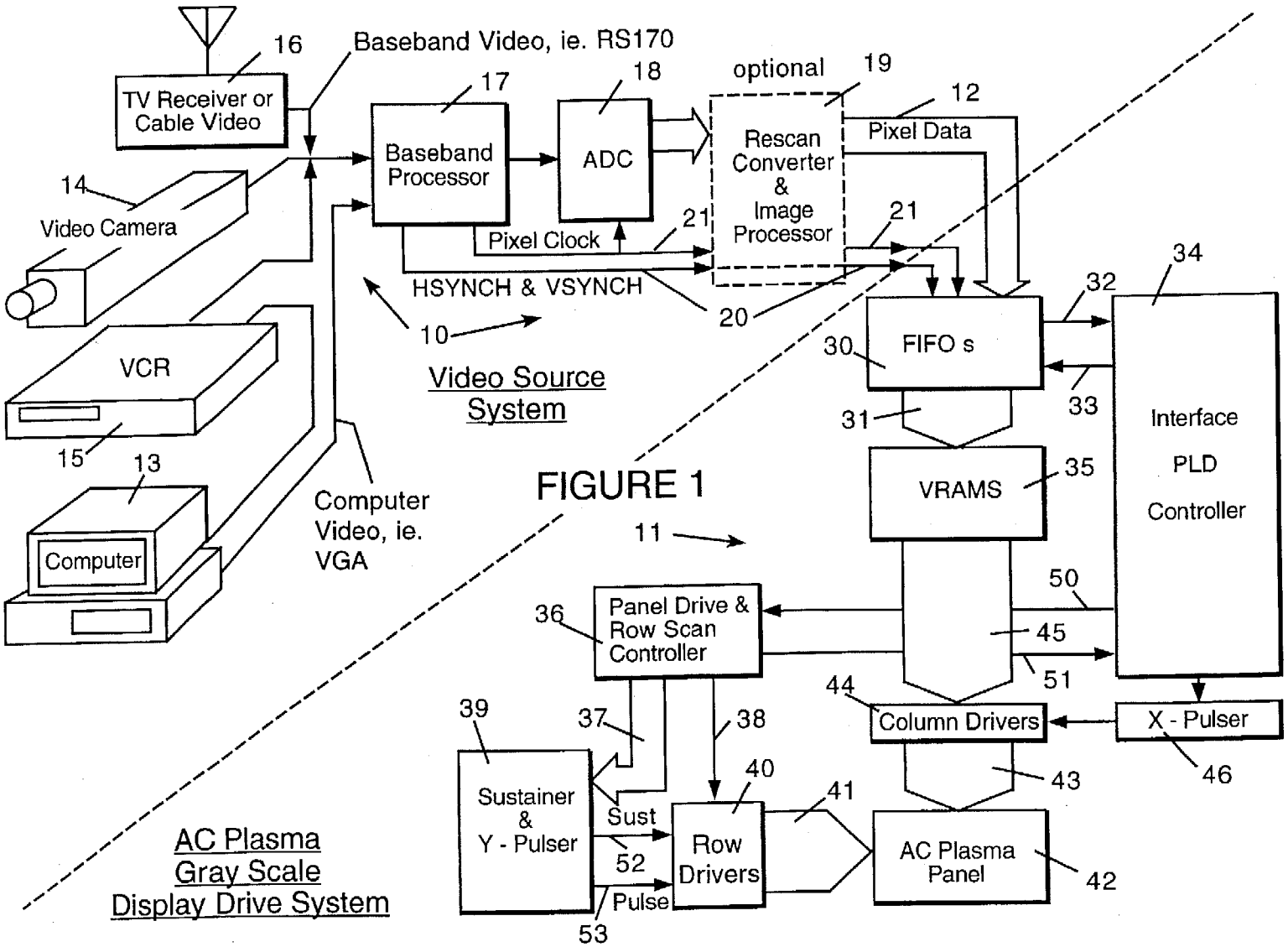
Figure 2:
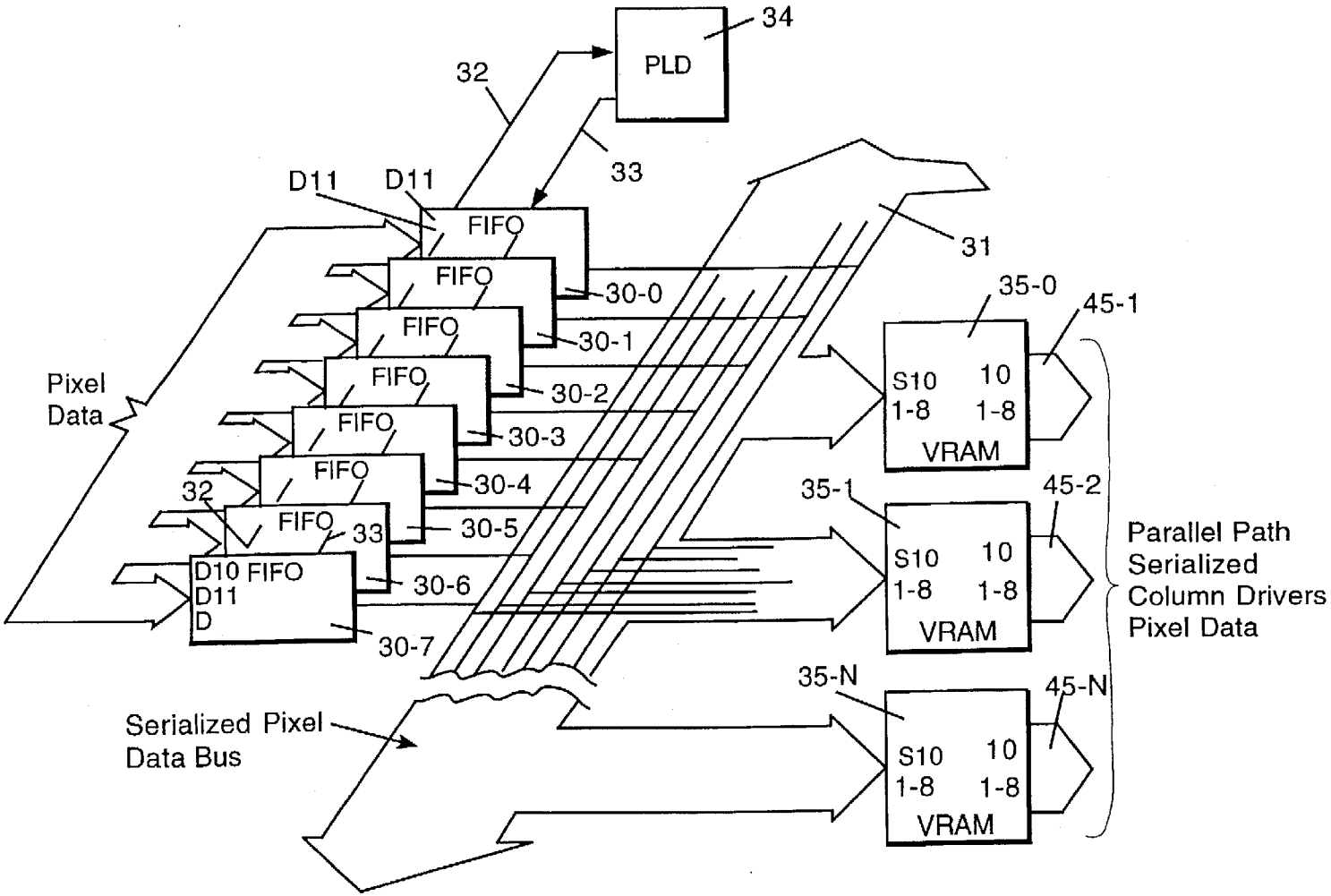
Figure 3:
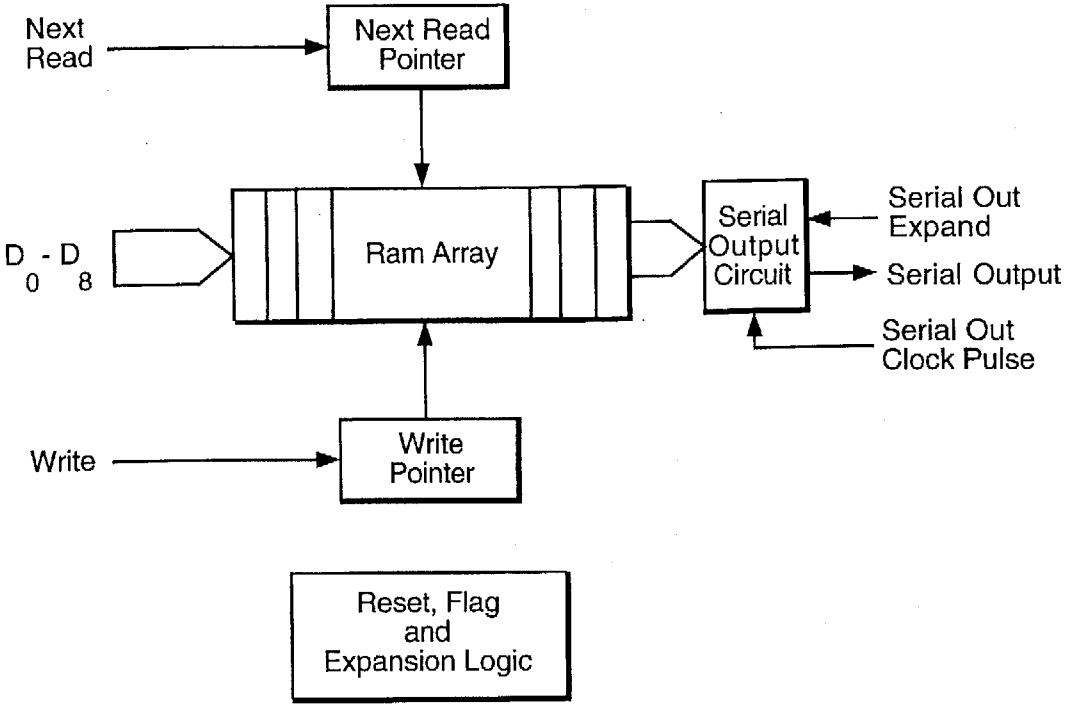
FIGURE 3 (PRIOR ART)
Figures 4A, 4B:
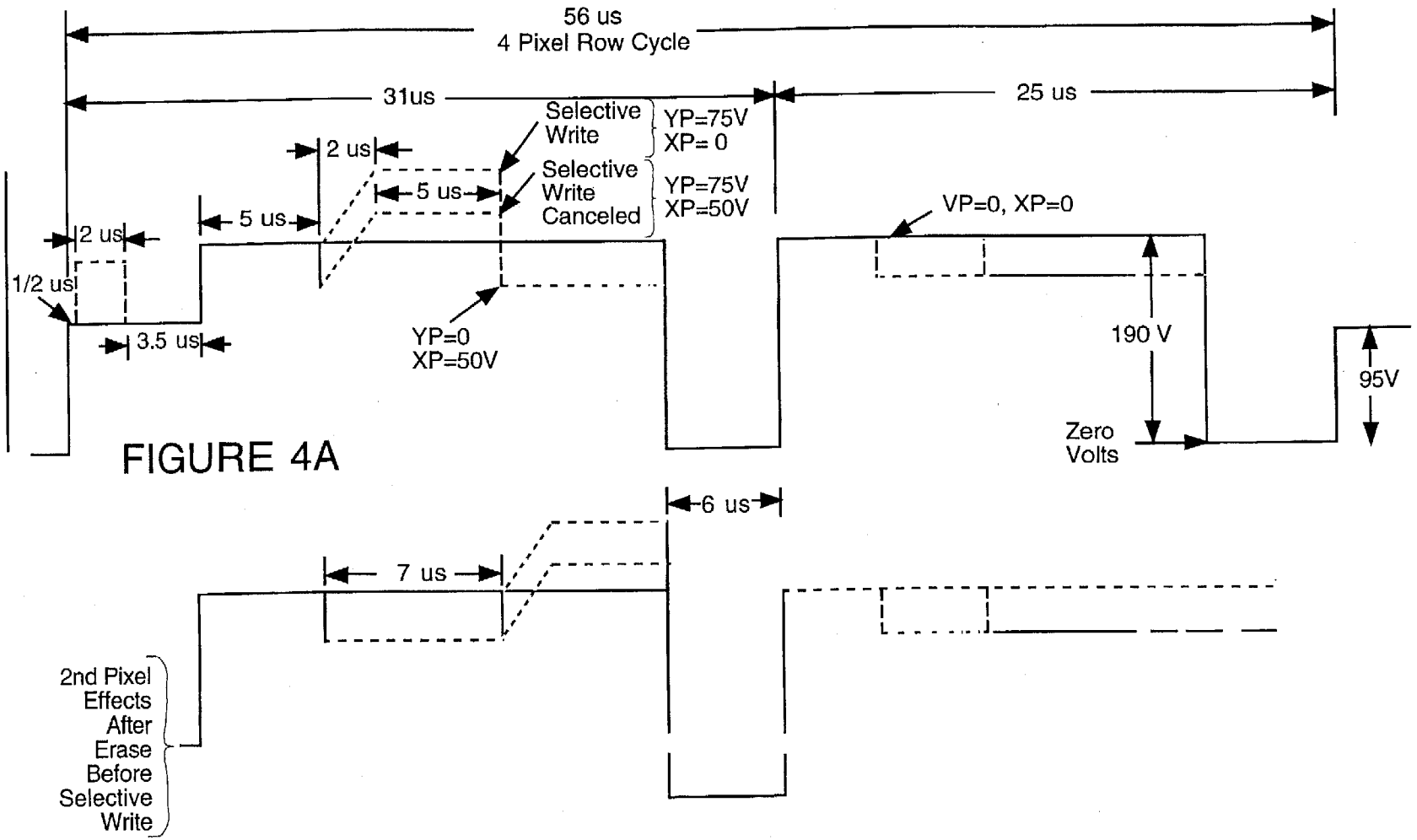
Figure 5A:
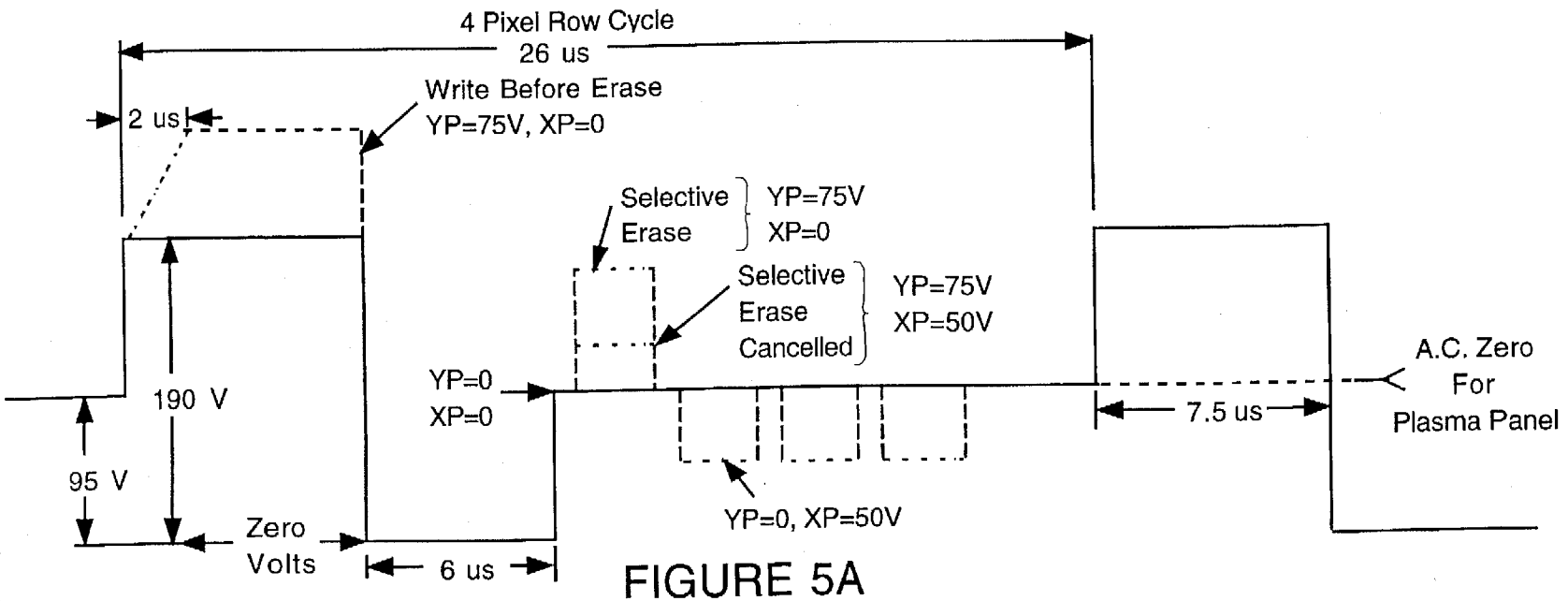
Figure 5B:
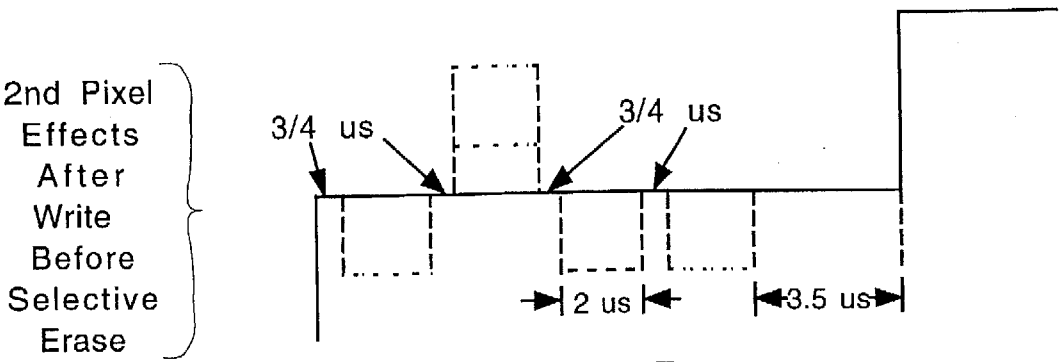
Figure 6:
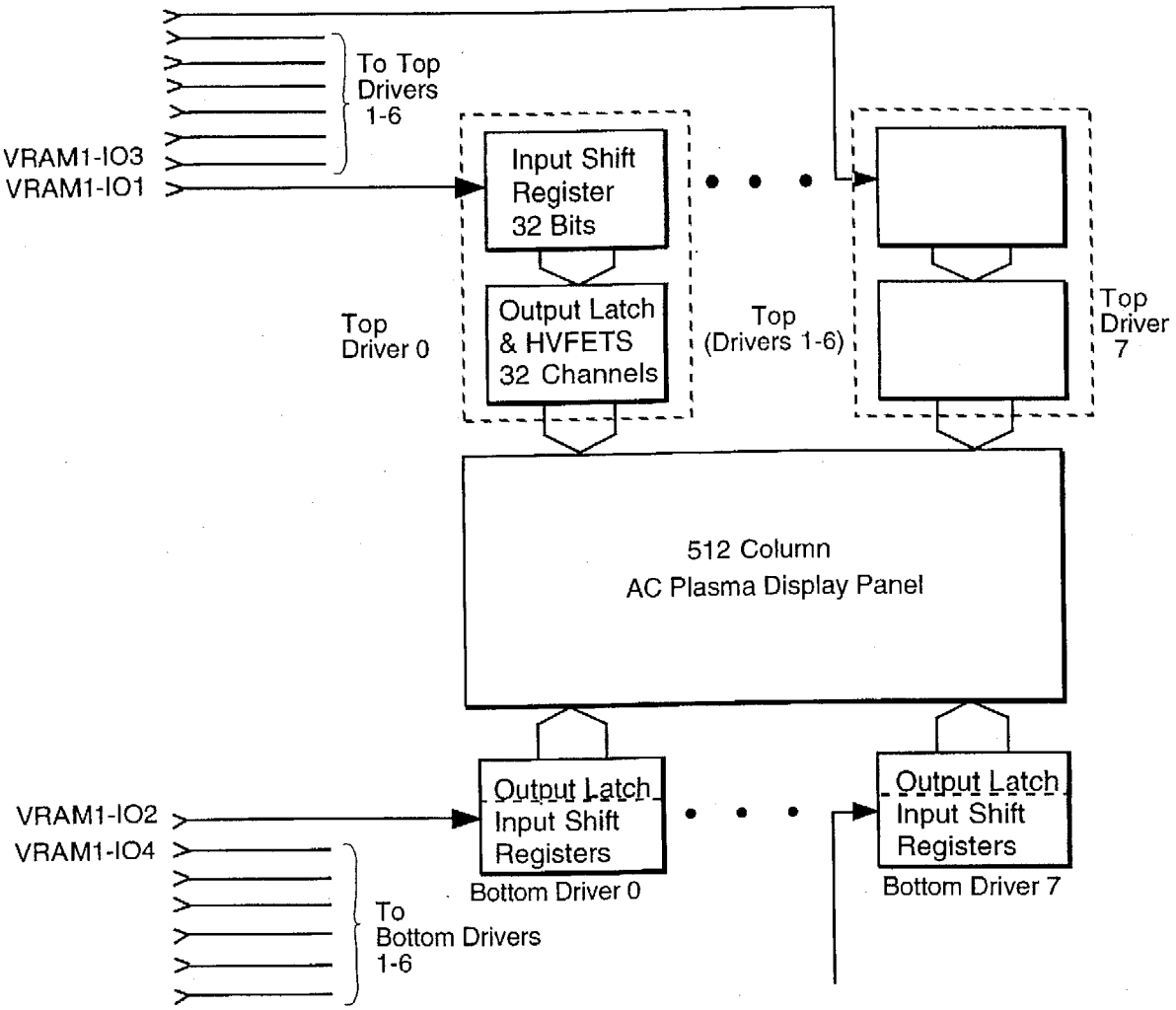
Figure 7:
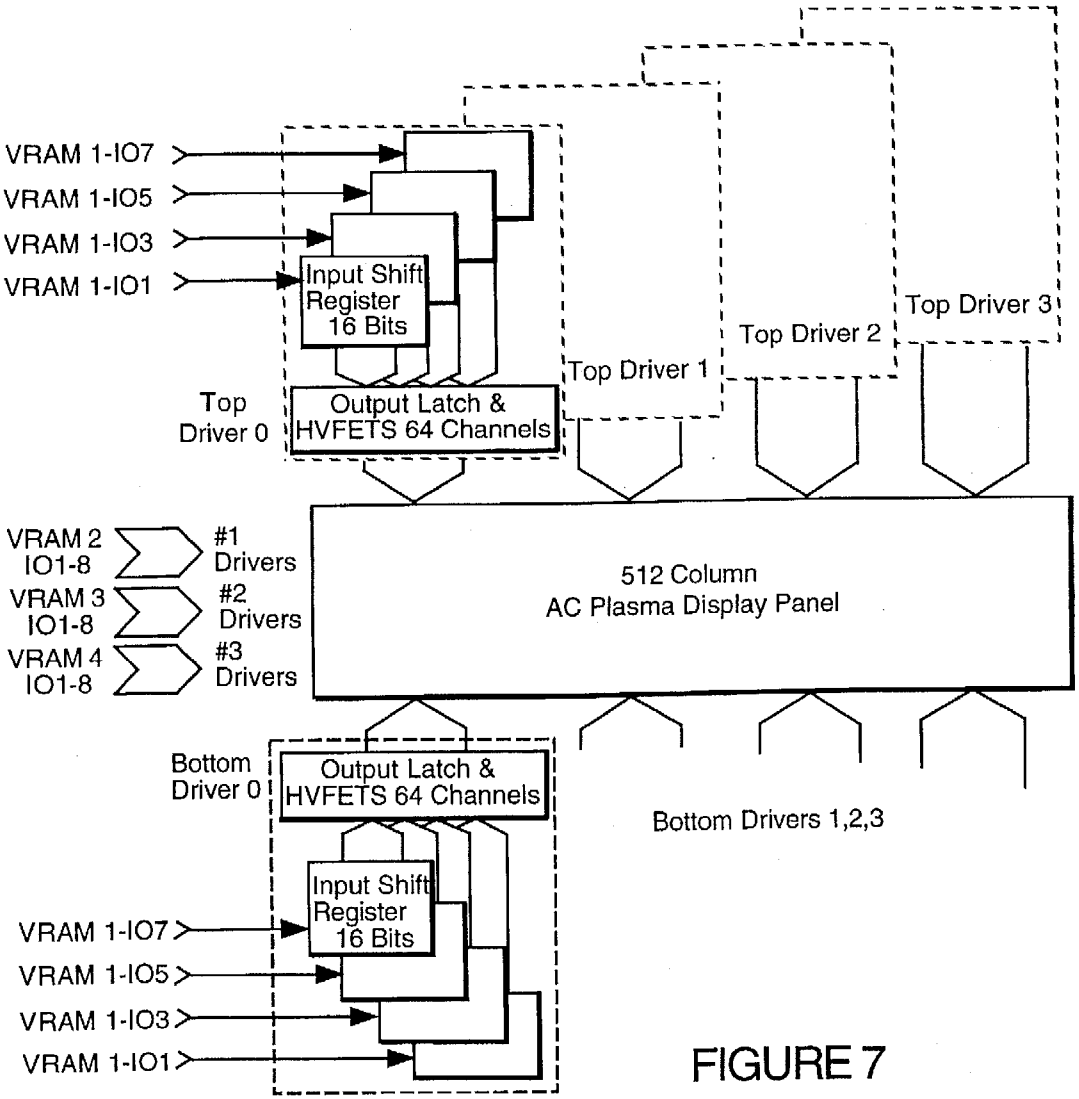

The above and other objects, advantages, and features of the invention will become more apparent when considered with the following specification and accompanying drawings wherein:

FIG. 1 is a functional block diagram of an drive system for A.C. plasma gas discharge system incorporating the invention, FIG. 2 is a block diagram for the high density memory architecture incorporating the invention, FIG. 3 is a functional block diagram of the FIFOs shown in FIG. 2, FIGS. 4*a* and 4*b* are diagrams illustrating the waveforms of the driving voltages incorporating the invention in one preferred mode of operation, FIGS. 5*a* and 5*b* are waveform diagrams illustrating a further preferred mode of operation of the invention, and FIGS. 6 and 7 illustrate typical driver architectures to be used with the systems of FIGS. 5*a*, 5*b* and 6*a*, 6*b*, respectively.

DETAILED DESCRIPTION OF THE INVENTION

According to the present invention, digitized video from a video source 10 (above the dashline) is presented to the drive system 11 (below the dash line) as a byte serial stream of pixel data on data bus 12. In an exemplary embodiment of the invention as disclosed herein, a byte is defined as 6 to 8 bits which represent at least 64 levels of gray scale for each pixel. In FIG. 1 is shown the functional diagram of the drive system 11 invention along with functional diagram of the video source system. The architecture of the drive system of this invention will accept 7 and 8 bit bytes for 128 and 256 levels of gray for each pixel where faster gas (non-neon) plasma panels are used.

The video source system 10 may contain a computer 13 with VGA 13 or similar type of digitized video output capability. The video source may also contain a camera 14, VCR 15 or TV receiver 16, or could also contain a combination of the above. In any case, the video source system 10 will employ a digitizer which provides the pixel byte stream into the invention's drive system. The digitizer consists of baseband processor 17 and analog-to-digital converter 18 (ADC). The video source system 10 may also incorporate rescan conversion and/or image processing circuit 19 to adjust gray scale values for global brightness offsets, for dithering techniques, or for non-linear gray scales. The digitizer and/or rescan converter may include "window" portion necessary to show on smaller screens, etc. The digitizer and rescan converter can contain circuitry, including memory to selectively capture and resynchronize video images and/or video graphics. The baseband processor could also incorporate multisynchronizing capabilities such as exist on many available VGA-type of monitors today. In any case, the digitizer and rescan converter could allow the capability, for example, to capture a 512×512 or 480×640 portion from a 768×1024 overall image. The selected image may then be resynchronized and transferred into the invention's drive system for display. It is also possible that a smaller physical image could be captured and resynchronized; and then displayed by the invention in a selected portion of a bigger matrix image.

The front end FIFO's of the invention contribute to the averaging of data rate in synchronization with the digitizer. This smoothing of the incoming data rate together with capturing a selected portion of image frames is further discussed below in the section about operation of the FIFOs and VRAMs.

The digitzer 17 is a necessary part of an overall display system in which the invention's drive system 11 is employed. In addition to providing the pixel byte stream, the digitizer 17, 18 must provide horizontal and vertical sync 20, and pixel clock 21. The invention provides for a timing scheme which allows even and odd frames to be discerned and appropriately processed according to the logic state of horizontal sync at the time of vertical sync deactivation.

FIG. 2 illustrates the functional and schematic diagram for the high density memory architecture in the invention's drive system. Directly receiving the pixel byte stream are FIFOs which accept the bytes on the input and convert the pixel bytes into serial bits at the FIFO outputs. FIG. 3 shows the functional diagram for such FIFOs. (See reference IDT 72131 "High Performance CMOS Data Book Supplement 1989, pp 56–96 through 56–108.). The serial bit outputs from the FIFOs are tied to the serial inputs of VRAMs as shown in FIG. 2.

The novel and unique application of the high density memory architecture according to the invention is centered on the serial throughput of pixel data from FIFOs to the VRAM inputs. The VRAMs are normally used to accept data in parallel and then output the data to video conversion circuits in serial. However, for the high speed serialized data from the FIFOs, the parallel inputs to the VRAMs are not fast enough. An architecture with SRAMs could be used to allow fast parallel accessing of pixel data through RAM, but significant dual porting control and multiplexing would be required as additional architecture functions; and SRAMs have only about 25% to 50% of the memory density of VRAMs, as well as a higher cost per bit. Hence, the VRAMs are utilized in the preferred embodiment.

A typical VRAM circuitry is disclosed in Toshiba Technical Data, TC 528126/AP/AJ-2, 1986-6-1, incorporated herein by reference. Separate I/O ports are provided for parallel and serial accessing of the VRAMs interval cell arrays. The parallel accessing occurs through combined row/column addressing while the serial accessing occurs through a starting column address and serial address counter. The serial address counter operates independently from the addressing except when preset with a starting column address. The serial I/O port stores transfer information in a serial access memory (SAM) which buffers column accesses to/from the internal cell array.

The VRAMs have built-in dual porting control and multiplexing by shifting into the VRAMs shift register and uploading to the RAM, instead of parallel accessing the VRAM and downloading into their shifting registers (and subsequently into the driver shift registers) pixel data is moved through the VRAM buffer sufficiently fast for the invention's requirements.

Pixel data bus 12, pixel clock on clock bus 21, and horizontal sync and vertical sync on sync bus 20 are supplied to the display drive system 11 to AC plasma panel 42 via the high density memory architecture centered on the serial throughput of pixel data from FIFOs 30 (shown in FIG. 2) to the VRAMs 35, thence via column driver bus 45 to the column driver 44 and column (X) conductors or electrodes 43 on the AC plasma panel 42. Interface controller 34 is a programmed logic device (PLD). Controller 34 receives the pixel clock data and horizontal sync and vertical sync signals on line 32 and issues FIFO control signals on line 33. Interface controller 34 also supplies signals to column or X pulse circuit 46 which supplies the column driver 44, as described further hereinafter. In addition, interface controller 34 is programmed to control panel drive and row scan controller 36 via lines 50 and line 51. Panel drive and row scan controller 36 via bus 37 causes sustainer and row or Y-pulser 39 to issue sustainer drive signals 52 and pulse drive signals on line 53 to row driver circuits 40 which are coupled to the row conductors or electrodes 41 on AC plasma panel 42. Timing and operation will be discussed in connection with the waveform diagrams of FIGS. 4*a* and 4*b*, 5*a* and 5*b*.

Movement of pixel data through the FIFOs and VRAMs is described as follows:

Operation of the FIFOs and VRAMs in the Exemplary Embodiment of FIG. 2

Referring to FIG. 2, the front of the display drive system are 8 FIFOs 30-0, 30-1, 30-2 . . . 30-7 which are all connected in parallel on their inputs; that is, the data input terminal DIO of all 8 FIFOs are connected together, data input terminal DIl of all 8 FIFOs are connected together, etc. The paralleled inputs of the FIFOs receive the gray scale encoded pixel bytes which are received from the video source and streamed to the display drive along with the horizontal sync, vertical sync and pixel clock.

Selection of which one of eight FIFOs gets the pixel data clocked in is from a programmed logic device 34 or ASIC. For purposes of explaining this invention, assume that the logic is contained in an EPLD, a programmed logic device manufactured by Altera, for example.

For FIG. 4, operation to be explained further below, order of FIFO usage is the first 64 data values go to FIFOs #0 and #1, the second 64 values to FIFOs #2 and #3, and so on until the 192nd to 255th are placed in FIFOs #6 and #7. Every other byte received goes into an even or odd numbered FIFO during the input sequence; that is, the even and odd numbered FIFOs are servicing data paths to the top or the bottom of the panel. (In a typical AC plasma display panel alternate conductors or electrodes on the glass plate or substrate are terminated in conductor pads or terminals at both sides of the plate to make connective access easier and the even and odd conductors at the top or bottom of the panel correspond thereto.)

For FIG. 5 operation to be explained further below, order of FIFO usage is the first 32 data values go to FIFOs #0 and #1, the second 32 values to FIFOs #2 and #3, and so on until the 96th to 127th are placed in FIFOs #6 and #7; with the cycle repeating again until 512 values are stored in the 8 FIFOs. Every other byte received goes into an even or odd numbered FIFO during the input sequence; that is, the even and odd numbered FIFOs are servicing data paths to the top or the bottom of the panel.

Note that with a 640 column display (VGA format), or for other widths such as 832 columns (132 character display) or 1024 columns (extended VGA); additional bytes must be stored in appropriate sequence in the FIFOs, and additional VRAMs must be added to accommodate the additional driver IC paths. The VRAMs each service 8 serial data paths to the driver ICs. For the FIG. 4 system, the serial path length for each load of the driver ICs is 32 bits. For the FIG. 5 system, the serial path length for each load of the driver ICs is 16 bits. For an 832 column display using the FIG. 5 system, the number of VRAMs necessary is 832/16/8=7. VRAM requirements for the various display sizes are listed as follows:

| ROWS | COLUMNS | SYSTEMS | NO. VRAMs |
|---|---|---|---|
| 256 | 512 | 4 | 2 |
| 512 | 512 | 5 | 4 |
| 480 | 640 | 5 | 5 |
| 512 | 832 | 5 | 7 |
| 512 | 1024 | 5 | 8 |

The average or sustained rate of received data is incoming at a rate consistent with NTSC or VGA formats, around 10 MHz for NTSC and around 20 MHz for VGA. For NTSC, the frame rate is 30 Hz. For VGA, the frame rate is at least 60 Hz. Therefore, VGA will be addressed specifically to represent compatibility with high speed requirements. In addition, FIG. 5 operation will be used in the following discussion, with the understanding that FIG. 4 operation is less demanding in speed of operation but sequences in similar fashion.

When the first 128 values are captured in FIFO, the EPLD triggers a serialization process which clocks out data from all 8 FIFOs 16 times into the VRAMs. The data serialization movement into VRAM from all 8 FIFOs is continued when the remaining 3 groups of 128 values for a 512 column display are captured. Total number of bits moved is 512×8=4096, which are moved in 8 parallel paths such that the serialization process has 512 clock pulses. The clock rate of the serialization process must at least match the incoming data rate (around 20 MHz) so that the FIFO will not overflow. This data rate is well within the output rate for the FIFOs which is 8 MHz and the input rate for the VRAMs which is 32 MHz.

For a 640 column display, the data rate is still around 20 MHz. For the 832 or 1024 column display, the serialization data rate is proportionately higher. Since the 832 column display video source would be a derivation from a 1024 column display video source, we will consider 1024 columns as the maximum requirement for data rate to deal with. The expected type of 1024 column display video source is enhanced VGA. At 60 Hz frame rate and 768 rows to scan horizontally, the data rate requirement is around 70 MHz. This is a burst rate though, with a sustained rate of 20% less due to horizontal and vertical blanking times. In addition, actual number of rows to display is only 512 of 768, or 33% less; i.e. sustained data rate needs to be only around 40 MHz because the input FIFOs can capture and hold all 1024 pixel bytes per line while serialization to the VRAMs occurs. However, the input FIFOs would be doubled (increased to two banks of 8 devices each), with one bank of FIFOs servicing the top of the panel (i.e. even electrodes) and the other bank servicing the bottom of the panel. Each path of pixel data would then only be operating at around 20 MHz, which is again well within the data rate range of the FIFOs and VRAMs.

Serialized shifting into the VRAMs occurs from a pixel data bus as shown in FIG. 2. While the first 128 pixels of the line are being clocked into VRAM-I, the 2nd 128 pixels are being placed into the FIFOs, to be clocked out to VRAM-II when all of the 2nd 128 pixels are captured in FIFO. When all 512 pixels have been written to the SAM port of the VRAMs, the SAM ports are uploaded into the RAM array of the VRAMs. (The typical internal circuitry and connections thereto are displayed in the above-referenced Toshiba publication). Note as additional clarification of the above, that any periodic lagging of the SAM port loading process behind the input bursts of data can be recovered during the time gained during horizontal sync and/or data disable time.

The preceding paragraph's discussion was based on a 512 column display in FIG. 5 mode. For additional columns, additional VRAMs must be added to the serialization/SAM loading sequence consistent with the invention's memory architecture. For FIG. 4 operation, pixels would be captured and serialized in groups of 256 pixels, but the type of SAM loading would be the same as for FIG. 5 operation.

Uploading the VRAMs' SAMs into their RAM arrays is done in parallel (all VRAMs uploaded at the same time), and requires only around 300 nanoseconds. This upload is deferred in the EPLD until the plasma drive waveform timing permits it; the VRAMs' parallel access ports are available to the transfer of data to the column drivers on a first priority basis.

The VRAMs are accessed in parallel (all VRAMs unloaded at the same time) to load the column drivers at the display panel. For FIG. 5 operation, the VRAMs are addressed to cause each pixel row of column data to appear at the VRAMs' parallel port outputs (I01–8) in 16 consecutive read operations such that the pixel data appears from the VRAMs in the same order in which it was captured in the FIFOs. For each row of pixel data, 16 bits are accessed from the VRAMs' parallel port outputs and are shifted into the column drivers in the arrangement as shown in FIG. 7.

Table I summarizes the result of unloading the VRAMs into the column drivers, including data path from input to FIFOs through to driver output onto the display matrix.

Table I shows the sequences for moving column data for pixel row 1 through the invention's drive system. The same sequence is repeated for each pixel row, with the pixel data 0 being left most in each row and pixel data 511 being right most. Note that Table I is for a 512 pixel column display, and can readily be modified to illustrate other column configurations.

TABLE I

| (BYTES) PIXEL DATA | FIFO/VRAM BUFFER DATA | VRAM OUTPUT | DISPLAY PIXEL |
|---|---|---|---|
| 0 thru 30 Even | FIFO 0/VRAM I | VRAM I-IO1 (Top Driver 0) | 0 thru 30 Even |
| 1 thru 31 Odd | FIFO 1/VRAM I | VRAM I-IO2 (Bottom Driver 0) | 1 thru 31 Odd |
| 32 thru 62 Even | FIFO 2/VRAM I | VRAM I-IO3 (Top Driver 0) | 32 thru 62 Even |
| 33 thru 63 Odd | FIFO 3/VRAM I | VRAM I-IO4 (Bottom Driver 0) | 33 thru 63 Odd |
| . | . | . | . |
| . | . | . | . |
| . | . | . | . |
| 96 thru 126 Even | FIFO 6/VRAM I | VRAM I-IO7 (Top Driver 0) | 96 thru 126 Even |
| 97 thru 127 Odd | FIFO 7/VRAM I | VRAM I-IO8 (Bottom Driver 0) | 97 thru 127 Odd |

TABLE I-continued

| (BYTES) PIXEL DATA | FIFO/VRAM BUFFER DATA | VRAM OUTPUT | DISPLAY PIXEL |
|---|---|---|---|
| 128 thru 158 Odd | FIFO 0/VRAM II | VRAM II-IO1 (Bottom Driver 1) | 128 thru 158 Odd |
| . | . | . | . |
| . | . | . | . |
| . | . | . | . |
| 224 thru 254 Even | FIFO 6/VRAM II | VRAM II-IO7 (Top Driver #1) | 224 thru 254 Even |
| 225 thru 255 Odd | FIFO 7/VRAM II | VRAM II-IO8 (Bottom Driver #1) | 225 thru 255 Odd |
| 256 thru 286 Even | FIFO 0/VRAM III | VRAM III-IO1 (Top Driver #2) | 256 thru 286 Even |
| . | . | . | . |
| . | . | . | . |
| . | . | . | . |
| 481 thru 511 Odd | FIFO 7/VRAM IV | VRAM IV-IO8 (Bottom Driver #3) | 481 thru 511 ODD |

The invention's memory architecture specifically provides the above described direct throughput of pixel data without bit rotation or translation enroute to the display drivers, and without interleaving at the driver outputs (Reference Supertex HV77), or in conventional printed circuit connections to the ACP panel. The invention's memory architecture specifically provides direct pixel orientation for gray scale control by accumulative geometric on-time per frame.

Drive Waveforms

The invention's waveforms for driving the panel are shown in FIGS. 4 and 5 in solid outline. These sustaining drive (sustainer) waveforms are created entirely from the Y-axis side of the panel. Also shown in FIGS. 4 and 5 in dashed outlines are the resultant pixel control voltages from the difference of X-axis and Y-axis cancellation and select pulses. The pixel select voltage (pulse level which determines whether it is to be activated, erased or simply not affected) is YP-XP. If YP-XP is 75 volts nominal in addition to the sustainer level, then a pixel select occurs. As shown in FIGS. 4 and 5, YP-XP occurs when YP is 75 volts (with respect to the sustainer voltage) and XP is zero. When XP is pulsed to 50 volts nominal, YP is effectively cancelled if it is pulsing to 75 volts, because the pixel control voltage is only 25 volts with respect to the sustainer voltage; the selective voltage level to affect the pixel at the YP-XP electrode intersection is 50 volts reduced.

If YP is zero when XP pulses to 50 volts, then the affected pixel(s) will experience a momentary reduction of 50 volts from the sustainer voltage. This momentary dropout in voltage has no affect on pixels which have reached equilibrium in the sustain cycle. Basically, if the composite waveforms have voltage dropouts after 5 microseconds from a sustain transition (total change of zero to 190 volts nominal), then the voltage dropout will not perturb the pixel's sustain function. The composite waveform's have been designed to satisfy this condition.

The X-axis control voltages are imposed on the panel column electrodes from the outputs of driver ICs (TI75556 or Supertex HV56 type for FIG. 4, and modified Supertex HV77 for FIG. 5) which are logic ground based. The Y-axis control voltage is superimposed on the drive voltage from the outputs of driver ICs (TI 75556 or modified Supertex HV77) which are sustainer drive voltage based. Functional/schematic diagrams of the X-axis driver ICS together with their interconnect to the VRAMs are shown in FIGS. 6 and 7. The input shift registers are coupled to the VRAM outputs as indicated and their respective outputs are supplied to conventional driver circuits as illustrated.

FIG. 4 differs from FIG. 5 in that erase before write sequence is used for FIG. 4 and write before erase sequence is used for FIG. 5. In erase before write sequence, each pixel row to be addressed for selectively writing the pixels, is first non-selectively or bulk erased. No column control voltage is applied during the row bulk erase part of the sequence. After any active pixels in a row being addressed have been erased (extinguished), then the row's pixels to be activated in accordance with the gray scale operation are selectively written (activated) by the combination of X and Y axis control voltages applied to the addressed row at the same time.

In write before erase sequence, each pixel row to be addressed for selectively erasing the pixels, is first non-selectively or bulk written. No column control voltage is applied during the row bulk write part of the sequence. After all pixels in a row being addressed have been written, then the row's pixels to be extinguished in accordance with the gray scale operation are selectively erased by the combination of X and Y axis control voltages applied to the addressed row at the same time.

Note as shown in FIGS. 4 and 5, that the actual number of rows non-selectively erased or written in a physical cycle of the waveforms is four. More than four in a cycle extends the physical cycle time to result in a sustain frequency less than 38 KHz (approximately the same as for binary video AC plasma displays) and reduces global brightness. Less than four in a cycle requires more overall cycles in a frame to accommodate the gray scale operation, which causes frame rate to be reduced below 46 Hz and flicker to increase.

In the waveforms, the X-axis control voltage is used to selectively cancel the Y-axis control voltage. This selective cancellation technique is of primary importance to high speed operation which allows flicker to be avoided as follows:

a) Current and prior art AC plasma display drive systems generally have employed half-select waveforms; that is, up to half of the control voltage for any addressing and some of the drive voltage to the panel must be supplied from the X-axis. In such drive systems where erase before write or write before erase is employed, the bulk erase or bulk write function requires an X-axis control contribution. This takes time in the X-axis control cycle which is avoided with the selective cancellation technique of the invention. Therefore all of the physical cycle time is dedicated to pixel control on the X-axis with selective cancellation.

b) To achieve video rate performance in half-select drive systems, the X-axis driver ICs 44 should be referenced to the control voltage in order to adequately carry drive currents through output diodes instead of output transistors in the ICs. Because their reference is not to logic ground, the X-axis driver ICs in half-select drive systems require an isolation interface with a transformer or optical coupler circuit for each IC. The isolation interface limits speed of operation due to limitations in the rise and fall times of transformers and optical couplers. Especially for the waveform technique of FIG. 5, which requires 10 MHz data rates, the isolation interface is not practical. The selective cancellation technique eliminates the isolation interface which also results in major circuit function and component reduction in comparison to the half-select drive system.

Gray scale operation is accomplished with the FIG. 4 waveform as follows:

a) At the beginning of the gray scale cycle, a bulk erase of 4 pixel rows occurs. This occurs at the front of one physical (sustain) cycle of 31 microseconds duration. The bulk erase occurs at the zero voltage level for the drive voltage waveform in accordance with the discussions for erasing discussed earlier in the "Background" discussion.

b) Immediately following the bulk erase operation, and in the same physical cycle, two of the four pixel rows just bulk erased are selectively written.

c) In a second physical cycle of 25 microseconds, the last two of four pixel rows just bulk erased are selectively written.

d) The combined cycle time of the physical cycles is 56 microseconds. Therefore, each pixel row to be updated for gray scale operation requires 14 microseconds with the FIG. 4 waveform, and the average physical waveform cycle time is 28 microseconds corresponding to a sustain frequency of 38 KHz.

e) Voltage levels shown are nominal values; the exact values are determined from the optimum operating point in the display panel's window, and are supplied from the output of a conventional variable power supply.

Gray scale operation is accomplished with the FIG. 5 waveform as follows:

a) At the beginning of the gray scale cycle, a bulk write of 4 pixel rows occurs. This occurs at the front of one physical (sustain) cycle of 28 microseconds duration. The bulk write occurs at the maximum voltage level for the drive voltage waveform.

b) Immediately following the bulk write operation, and in the same physical cycle, the four pixel rows just bulk written are selectively erased. The selective erases occur at the zero voltage level for the drive voltage waveform in accordance with the discussions for erasing in the background section of this invention.

c) The duration of the physical cycle is 28 microseconds; each pixel row to be updated for gray scale operation requires 7 microseconds with the FIG. 5 waveform, and the corresponding sustain frequency is 38 KHz.

d) Voltage levels shown are nominal values; the exact values are determined from the optimum operating point in the display panel's window, and are supplied from the output of a convention variable power supply.

The FIG. 5 technique is twice as fast as the FIG. 4 technique in providing update of 4 pixel rows at a time. Therefore, twice as many gray scale levels can be provided with FIG. 5. This is primarily because selective erase can occur in only 2 microseconds and selective write requires at least 5 microseconds, not including rise time control. However, with write before erase, a faint background glow is present at all times because all pixels are activated momentarily before selective erase. This background glow causes loss of the lowest gray scale levels; completely extinguished, 1/128th and 1/64th. In normally lighted rooms, this background glow or loss of lowest gray scale levels is generally not noticeable, but can be an issue in dark room applications such as "rigged for red" in submarines.

The FIG. 5 technique is also not as efficient in the use of VRAM as the FIG. 4 technique because serial data paths to the driver ICs are only 16 bits in length. Therefore, for the same number of columns to display, the FIG. 5 technique requires twice as many VRAM outputs (and therefore more ICs) to the driver ICs as for the FIG. 4 technique, i.e. see the table above in the discussion of memory architecture about number of VRAMs as a function of display size and drive technique. Note that, the bigger the display matrix, the more efficient the VRAM utilization. Also note that if faster driver ICs were available to shift 32 bits per data path at 20 MHz, then VRAMs could again be reduced to the same number as required for the FIG. 4 technique.

Both FIGS. 4 and 5 techniques employ ramped write pulses. This is necessary to avoid crosstalk to surrounding pixel rows because of the extra discharge energy in the write pulse and also due to the write pulse happening where the sustain voltage is at its highest level(s). Ramping the erase pulse is not necessary because it has less energy, is happening at low sustain voltage levels and is not as disturbing to adjacent pixel rows. Note that in the FIG. 5 waveform, the write pulse is allowed to begin immediately after a sustain transition because cells which have discharged at the transition will not be affected by an increase in voltage and cells which have not discharged will be activated when the write pulse reaches its peak; and at the end of the write pulse, all cells in the selected pixel row will remain active because another sustain transition occurs.

Gray Scale Timing Operation

Gray scale is created on a pixel-by-pixel basis by successively scanning the pixel gray scale values in the VRAMs 35 and accordingly adjusting the X-axis control voltage to the panel several times per overall frame. Gray scale level (the amount of total time that a pixel is activated in an overall frame time; i.e., pixel on-time per frame) is an accumulation of the multiple times when the pixel is activated due to the X-axis control adjustments during each overall frame time.

The method of accumulating geometrically progressive pixel on-times is used in this invention. For 64 levels of gray scale, control voltages to the panel are adjusted or pulsed at each pixel in multiples of 1/64ths of the total frame time. Therefore, 64 different total pixel on-times can be created from summation of the following 6 on-times resulting in 64 different levels of gray scale, with each level being separated from another by 1/64th of full brightness. As such, the control voltages to the driver ICs need only be adjusted 6 times in each frame time for each pixel.

| | | |
|---|---|---|
| 1/64th | 1/32nd | 1/16th |
| 1/8th | 1/4th | 1/2 |

This invention also exploits the arrangement of pixel data stored in the VRAMs. Since the pixel data is loaded into the VRAM memory array via the serial input port, it is arranged such that it appears serially when accessed in parallel from the VRAM to be shifted into the X-axis driver ICs. As the bits of gray scale value appear from VRAM at successive accesses when the control voltages are to be adjusted; the state of each bit directly determines the adjustment to be made to the pixel without further decoding. In other words, if the least significant bit of the pixel gray scale value is 1, then the pixel should be activated until the next bit is accessed. If the next bit is 1, then the pixel should remain activated and so on. At each successive bit which is accessed, the bit value determines whether the pixel should be extinguished or activated which results in the correct geometrically progressive accumulation of pixel on-time per frame.

Note that scanning of the display panel occurs a pixel row at a time; the Y-axis control voltage is selecting the rows to be erased and written, while the X-axis control voltage is selectively applied to all of the columns at once to block or cancel the Y-axis control voltage for pixels which are not to be affected. The X-axis driver ICs operate by serially collecting the bits for selecting the outputs to be activated with the control voltage.

For 64 levels of gray scale, the panel must be completely scanned once every 1/64th of an overall frame time, and each overall frame time must contain 6 scans. With FIG. 4, each pixel row can be scanned in 14 microseconds. The overall frame time for a 256 pixel row panel is 6×14 microseconds×256=21.5 milliseconds corresponding to a frame rate of 46 Hz.

For panels with 512 pixel rows, FIG. 6 implementation would yield 64 levels of gray scale at a 46 Hz frame rate since each pixel row can be scanned in 7 microseconds. Note that panels with pixel rows less than the 256 and 512 pixel rows will have inversely proportionate faster frame rates.

The invention provides a drive system for flat panel bistable matrix AC plasma gas discharge gray scale graphics and video displays which is able to provide in standard neon gas AC plasma panels at least 64 levels of gray in interlaced matrices of 256×512, 480×640, 512×512, 576×640, 512×832 and 512×1024, and up to 128 levels of gray in interlaced matrices of 256×512. Moreover, it provides gray scale while avoiding flicker with overall framerate of 46 Hz, nonsequential interlaced pixel row scanning, and accumulative geometric pixel on-time per frame. Gray scale according to the invention is provided with voltage drive waveforms which allow time to eliminate flicker and in which all of the drive voltage is applied from the row axis of the panel and the column axis is dedicated solely to high speed pixel control which is logic ground based. Another advantage of the invention is that the drive system is implemented in an efficient minimal design based on unique, unusual application of standard high density memory architecture in which video data is captured as bytes of column pixel data into FIFOs 30, serialized in the FIFOs 30 and shifted into all of the VRAM 35 serial access registers at one time, uploaded into VRAM memory arrays, and parallel accessed from all of the VRAMs at the same time for output into the display driver ICs. The invention incorporates a memory architecture specifically providing the above described direct throughput of pixel data without bit rotation or translation enroute to the display drivers, and without interleaving at the driver outputs, or in the printed circuit connections to the ACP panel; resulting in direct pixel orientation for gray scale control by accumulative geometric on-time per frame. The invention provides for a timing scheme which allows even and odd frames to be discerned and appropriately processed according to the logic state of horizontal sync at the time of vertical sync deactivation. As noted above, gray scale matrix display systems incorporating the invention avoid flicker with nonsequential interlaced pixel row scanning.

While there has been shown and described a preferred embodiment and modifications of the invention, it will be appreciated that various other modifications, embodiments and adaptations are intended to be encompassed by the claims appended hereto.

What is claimed is:

1. A drive system for an AC plasma display panel having pixel elements located by column (X) and row (Y) electrodes, X electrode driver means connected to the X electrodes and Y driver means connected to the Y electrodes and a source of N-bit word signals representing the amplitude of video signals for each pixel element located by the crossing of said X and Y electrodes and means for translating said N-bit word to driver signals for controlling the X and Y driver means to cause each pixel element to selectively emit light output storage elements, a first voltage driver means connected between the output storage elements and said X electrodes for supplying X axis control voltages to said column X electrodes, said first voltage driver means being dedicated solely to high speed pixel control which is logic ground based and a second voltage driver means connected between said output storage elements and said row (Y) electrodes for supplying Y axis control voltages to said row electrodes, said X axis control voltages being applied to said column (X) electrodes at selected times to selectively cancel said Y axis control voltage.

2. An AC plasma display system having an array of display pixels with memory in a flat panel, matrix display device, a source of digital signals wherein an N-bit word represents the amplitude of pixel data for each pixel element, said matrix display device having column (X) and row (Y) electrodes, column (X) and row (Y) driver means connected to the column (X) and row (Y) electrodes, respectively, and locating each said pixel element with memory, driver means includes (1) a first voltage driver means connected between said output storage elements and said column (X) electrode for supplying column (X) axis control voltages to said column (X) electrodes, said first voltage driver being dedicated solely to high speed pixel control which is logic ground based, and (2) second voltage driver means connected between said output storage elements and said row (Y) electrodes for supplying Y axis control voltages to said row electrodes, said X axis control voltages being applied to said column (X) electrodes at selected times to selectively cancel said Y axis control voltage, and means for translating said N-bit word to driver signals for controlling said driver means and cause each said pixel element with memory to selectively emit light and without bit rotation or translation to said driver means, said driver means for said row (Y) electrodes developing and applying a periodic sustainer voltage to said row (Y) electrodes, said means for translating comprising an array of parallel input first storage elements for capturing video data in columns of pixel data bytes and outputting in serial form from said parallel input storage elements said columns of pixel data bytes, an array of output storage elements for serially shifting pixel data bytes from said array of parallel input storage elements to said array of output storage elements at one time and means for parallel transferring said pixel data bytes from said output storage elements at the same time as said driver signals for controlling said drive means and cause each selected pixel element with memory to selectively emit light in said matrix display device.

3. The display system defined in claim 2 in which there are write, erase and sustain sequences for said pixels and wherein said means supplying X axis and Y axis control voltages to said column (X) and row (Y) electrodes so as to non-selectively erase each pixel row to be addressed while no column (X) control voltage is applied during the write sequence and after all active pixels have been erased, selectively writing pixels by applying simultaneous combinations of X and Y axis control voltages to selected pixels in a row.

4. The display system defined in claim 2 in which there are write, erase and sustain sequences for said pixels and wherein said driver means supply X axis and Y axis control voltages to said column (X) and row (Y) electrodes so as to non-selectively write each pixel row to be addressed while no column (X) control voltage is applied during the erase sequence and then selectively extinguishing pixels in said row by applying simultaneous combinations of X and Y axis control voltages to selected pixels in a row.

5. The invention defined in any one of claims 1–4 wherein said flat panel, matrix display device is a full color AC plasma display which employs pixel-by-pixel gray scale within each color channel.

* * * * *